US005090966A

United States Patent [19]

Crawford et al.

[11] Patent Number: 5,090,966

[45] Date of Patent: Feb. 25, 1992

[54] FUEL COMPOSITION CONTAINING AN ADDITIVE FOR REDUCING VALVE SEAT RECESSION

[75] Inventors: John Crawford, Caterham; Thakor Kikabhai, North Humberside; David B. McLeary, Woking; Andrew Pearce, North Humberside, all of United Kingdom

[73] Assignee: BP Chemicals (Additives) Limited, London, England

[21] Appl. No.: 582,016

[22] Filed: Sep. 13, 1990

Related U.S. Application Data

[63] Continuation of Ser. No. 184,385, Apr. 21, 1988, abandoned.

[30] Foreign Application Priority Data

Apr. 23, 1987 [GB] United Kingdom ..... 8709646
Oct. 6, 1987 [GB] United Kingdom ..... 8723434

[51] Int. Cl.[5] ..... C10L 1/12
[52] U.S. Cl. ..... 44/314; 44/318
[58] Field of Search ..... 44/314, 318

[56] References Cited

U.S. PATENT DOCUMENTS

| | | | |
|---|---|---|---|
| 2,579,257 | 12/1951 | Hansley et al. | 44/51 |
| 2,635,041 | 4/1953 | Hansley et al. | 44/51 |
| 3,002,825 | 10/1961 | Norris | 44/70 |
| 3,002,826 | 10/1961 | Norris | 44/51 |
| 3,272,605 | 9/1966 | Ambrose | 44/70 |
| 3,501,279 | 3/1970 | Allen et al. | 44/70 |
| 3,594,136 | 7/1971 | Rosen | 44/51 |
| 3,738,810 | 6/1973 | Wilner | 44/76 |
| 3,798,012 | 3/1974 | LeSuer | 44/76 |
| 3,955,938 | 5/1976 | Graham et al. | 44/51 |
| 4,164,472 | 8/1979 | Cheng et al. | 44/51 |
| 4,627,928 | 12/1986 | Karn | 44/51 |

FOREIGN PATENT DOCUMENTS

| | | | |
|---|---|---|---|
| 1143492 | 7/1986 | Japan | 44/70 |

*Primary Examiner*—Prince Willis, Jr.
*Assistant Examiner*—Ellen M. McAvoy
*Attorney, Agent, or Firm*—Brooks Haidt Haffner & Delahunty

[57] ABSTRACT

A fuel composition for use in internal combustion engines which composition comprises (A) a major amount of a fuel suitable for use in an internal combustion engine, preferably either a lead free or low-lead fuel for use in a spark ignition engine and (B) a minor amount of a composition comprising a metal salt in the form of a particulate dispersion. Examples of suitable metal salts include potassium borate, sodium borate, potassium carbonate and potassium bicarbonate.

13 Claims, No Drawings

FUEL COMPOSITION CONTAINING AN ADDITIVE FOR REDUCING VALVE SEAT RECESSION

This application is a continuation of application Ser. No. 07/184,385, filed Apr. 21, 1988, now abandoned.

The present invention in its most general form relates to fuel compositions for use in internal combustion engines of both the spark-ignition and compression ignition types. In a particular aspect it relates to fuel compositions for use in spark-ignition engines, which compositions contain an additive effective in reducing valve seat recession, particularly in lead-free or low-lead fuels.

During the past decade, a general reduction in the use of organo-lead in gasoline has occurred. This is due in part to concern over health effects related to lead emissions and in part also to the need for unleaded gasoline to prevent poisoning of metal catalysts used to control exhaust emissions. For example, the use of lead in regular grade gasoline is due to be phased out in West Germany in mid-1988. However, in that country alone about one million cars would be unable to operate on regular grade unleaded gasoline because of the potential problem with valve seat damage or recession. This problem is particularly prevalent with certain (older) engines with soft, e.g. cast iron, exhaust valve seats. During operation of these engines with leaded gasoline, lead decomposition products act as a solid lubricant and prevent wear of the valve seat by the harder exhaust valve. If such engines are operated on unleaded gasoline, they lose the protection of the solid lubricant and severe valve seat wear can ensue. In extreme cases the valve seat can become so worn that the valve recedes to the point where it fails to open. Catastrophic engine failure is the result.

The problem of valve seat sinkage or recession has by now become well recognised in the art and a number of solutions to the problem have been proposed in patent publications. Representative of these may be mentioned EP-A-0207560 and WO 87/01126.

EP-A-0207560 discloses a gasoline composition comprising a major amount of a gasoline suitable for use in spark-ignition engines and a minor amount of an alkali metal or alkaline earth metal salt of a succinic acid derivative having as a substituent on at least one of its alpha-carbon atoms an unsubstituted or substituted aliphatic hydrocarbon group having from 20 to 200 carbon atoms, or of a succinic acid derivative having as a substituent on one of its alpha-carbon atoms an unsubstituted or substituted hydrocarbon group having from 20 to 200 carbon atoms which is connected to the other alpha-carbon atom by means of a hydrocarbon moiety having from 1 to 6 carbon atoms, forming a ring structure. The aforesaid compounds are reported to improve the flame speed in the cylinder of the engine, thereby improving combustion, and not to give rise to any fouling in the engine.

In Example 5 of this patent the use of the salt of the succinic acid derivative for reducing valve seat recession is illustrated.

WO 87/01126 discloses a fuel composition for internal combustion engines comprising a major amount of a liquid hydrocarbon fuel and a minor amount sufficient to reduce valve seat recession when the fuel is used in an internal combustion engine of (A) at least one hydrocarbon-soluble alkali or alkaline earth metal containing composition, and (B) at least one hydrocarbon-soluble ashless dispersant. The composition (A) may be an alkali metal or alkaline earth metal salt of a sulphur acid, for example a sulphonic acid, a phosphorous acid, a carboxylic acid or a phenol.

We have now found that additives comprising metals salts, for example alkali or alkaline earth metals salts, in the form of particulate dispersions thereof are desirable additives for internal combustion engine fuels, in particular for reducing valve seat recession in spark-ignition engines. The additives may also improve detergency and improve combustion by a spark aider type mechanism.

Potassium borate, for example, has been used in lubricating oil compositions. Thus, U.S. Pat. No. 3,997,454 discloses an extreme-pressure lubricating composition comprising an oil of lubricating viscosity having dispersed therein 1 to 60 weight percent of hydrated potassium borate microparticles having a boron-to-potassium ratio of about 2.5 to 4.5 and, optionally, from 0.01 to 5.0 weight percent of an antiwear agent selected from (a) zinc dihydrocarbyl dithiophosphates having from 4 to 20 carbon atoms in each hydrocarbyl group, (b) a $C_1$ to $C_{20}$ ester, $C_1$ to $C_{20}$ amide, or $C_1$ to $C_{20}$ amine salt of a dihydrocarbyl dithiophosphoric acid having from 4 to 20 carbon atoms in each hydrocarbyl group, or (c) mixtures thereof. However, to our knowledge, its use has never been proposed in connection with fuel compositions and its utility in this connection must be regarded as surprising.

Furthermore, it is known from DD 200521A and J53141184 for example to incorporate metal salts in fuel additives, though not as particulate dispersions of the metal salts but as solutions thereof and not for the same purpose as the additives of the present invention.

Accordingly, the present invention provides a fuel composition for use in internal combustion engines which composition comprises (A) a major amount of a fuel suitable for use in an internal combustion engine and (B) a minor amount of a composition comprising a metal salt in the form of a particulate dispersion.

As regards component (A), the fuel may be a fuel suitable for use in a spark ignition engine, for example an automobile engine, or a compression ignition engine, for example a diesel engine, though the present invention is primarily directed to fuels for spark ignition engines, hereinafter referred to as gasolines, and the remainder of the description will in consequence be wholly devoted to such fuels. The gasoline may suitably comprise a hydrocarbon or hydrocarbon mixture boiling essentially in the gasoline boiling range, i.e. from 30° to 230° C.

The gasoline may comprise mixtures of saturated, olefinic and aromatic hydrocarbons. They may be derived for example from straight-run gasoline, synthetically produced aromatic hydrocarbon mixtures, thermally or catalytically cracked hydrocarbons, hydrocracked petroleum fractions or catalytically reformed hydrocarbons. Generally, the octane number of the gasoline will be greater than 65. A proportion of hydrocarbons may be replaced for example by alcohols, ethers, ketones or esters.

As regards component (B) of the composition, the metal is preferably either an alkali or alkaline earth metal, more preferably an alkali metal, most preferably either sodium or potassium. The salt may suitable be a salt of a carboxylic acid, carbonic acid or boric acid, though the salts of other acids may be employed. It is preferred to use water soluble salts. Examples of suitable salts include potassium acetate, potassium bicarbonate, potassium carbonate, sodium borate and potassium borate.

The composition will preferably also include a carrier for the metal salt, which may suitably be a gasoline compatible high-boiling material. Suitable carrier materials include mineral oils which may be solvent refined or otherwise, synthetic lubricating oils, for example of the ester type, liquid polyolefins, for example low molecular weight polyisobutenes, or their oxidised or aminated derivatives, amino and hydroxy derivatives of polyolefins, olefin copolymers, or hydrotreated base stocks sulphonates, succinimides, polyisobutene succinic anhydrides or their polycyclic alcohol derivatives, polyethers, polymethacrylates or PMP esters.

The metal salt is preferably incorporated in the carrier in the form of a particulate dispersion of the metal salt, suitably having a mean particle size of less than 1 micron, preferably less than 0.5 micron.

In a preferred embodiment of the present invention component (B) comprises either an alkali metal or alkaline earth metal borate in the form of a particulate dispersion in a carrier, the molar ratio of boron to metal being in the range from 0.33 to about 4.5, preferably from 0.33 to 2.5, more preferably about 1:1.

Although the preparation of metal borate dispersions for use as component (B) of the fuel composition will be described in detail hereinafter, the preparation of boron-free metal salt dispersions may be accomplished in similar manner.

A suitable metal borate dispersion for use as component (B) of the fuel composition may be prepared by wholly or partially desolvating a solvent-in-carrier emulsion of a solution of metal hydroxide and boric acid to provide a boron to metal molar ratio of Z/3 (wherein Z is the valency of the metal) to 4.5.

Suitable solvents include hydrocarbon and substituted hydrocarbon solvents of relatively low boiling point and water. A preferred solvent is water.

Typically, using an alkali metal which is either potassium or sodium as a representative example, the method may be effected by introducing into an inert, nonpolar carrier as hereinbefore described an aqueous solution of the alkali metal hydroxide and boric acid (metal borate solution) and preferably an emulsifier, vigorously agitating the mixture to provide an emulsion of the aqueous solution in the carrier and then heating at a temperature and for a time sufficient to provide the predetermined degree of dehydration of the emulsion. Suitably the temperature at which the emulsion is heated may be in the range from 60° to 230° C., preferably from 80° to 140° C., though lower temperatures may be used at sub-atmospheric pressures. However, it will usually be found convenient to operate at atmospheric pressure.

An alternative method for preparing the alkali metal borate dispersion comprises reacting an alkali metal carbonate-overbased carrier-soluble alkali metal sulphonate with boric acid to form an alkali metal borate reaction product. The amount of boric acid reacted with the alkali metal carbonate should be sufficient to prepare an alkali metal borate having a boron to alkali metal molar ratio of at least 5. The alkali metal borate is converted to the alkali metal borate of this invention by contacting the intermediate borate reaction product with a sufficient amount of alkali metal hydroxide so as to prepare the alkali metal borate having a boron to alkali metal molar ratio between 0.33 and 4.5. The water content may thereafter be adjusted if so required. The reaction of the alkali metal carbonate-overbased metal sulphonate with boric acid and the subsequent reaction with alkali metal hydroxide may be conducted at a temperature in the range from 20° to 200° C., preferably from 20° to 150° C. A reaction diluent may be present during the two reaction stages and subsequently removed by conventional stripping steps.

As mentioned hereinbefore an emulsifier is preferably employed in the preparation of the emulsion. Suitable emulsifiers include neutral sulphonates, succinimides, polyisobutene succinic anhydrides and their polyhydric alcohol derivatives, polyethers, polyolefin amines and hydroxy derivatives, olefin copolymers, oxidised polybutenes and their aminated derivatives, polymethacrylates and PMP esters.

A further method of preparing an alkaline earth metal borate dispersion is described in GB-A-2173419.

The composition comprising component (B) of the fuel composition is preferably a concentrate, from 1 to 99%, preferably from 20 to 70%, by weight of which is the metal salt. Component (B) is preferably present in the fuel composition of the invention in an amount such that it provides at least 2 ppm, typically about 10 ppm by weight of metal, for example potassium or sodium, based on the total weight of the composition.

In addition to the essential components (A) and (B), the fuel composition preferably also contains at least one fuel soluble detergent additive. Suitable detergents include polyolefin amines, for example polybutene amines, polyether amines, fatty acid amines, organic and metallic sulphonates of both the neutral and overbased types, and the like.

The fuel composition may also contain one or more rust inhibitors. Suitable rust inhibitors include for example succinic acid, carboxylic acids, phosphoric acid and derivatives of the aforesaid acids, amides, and the like.

Optionally the fuel composition may also contain one or more demulsifiers, for example a polyoxyalkylene glycol or a derivative thereof.

The fuel composition may also contain additives conventionally present in such compositions, for example one or more antioxidants.

Finally, the fuel composition may also contain a spark aider or cyclic variability reducer.

The detergent(s), rust inhibitor(s), demulsifier(s), antioxidant(s) and/or spark aider(s) may be added either directly to the fuel composition or as a component of the composition forming component (B) of the fuel composition.

The component (B) of the composition is preferably used in combination with either a low-lead or lead-free gasoline, as component (A) of the composition.

The invention will now be further illustrated by reference to the following examples.

(A) PREPARATION OF COMPONENT (B)

(I) Preparation of Metal Borate Dispersions

EXAMPLES 1 AND 2

An inorganic phase, prepared by reacting an alkali metal hydroxide with boric acid in water at 40° C. was added to an organic phase comprising a dispersant (a pentaerythritol pibsate ester) in a carrier (Example 1—SN100 base oil; Example 2—White Oil) in a homogeniser (a single stage laboratory homogeniser) over a period of 1 hour at 300–400 bar. The reactants were circulated through the homogeniser at 500–700 bar for a further 4 hours whereupon much of the water evaporated. The product, a clear liquid, was drained from the homogeniser and used without further processing.

Specific combinations and charges are given in Table 1.

TABLE 1

| | Example 1 | Example 2 |
|---|---|---|
| Alkali metal | Sodium | Potassium |
| Carrier | SN 100 base oil | White Oil |
| Dispersant | an ester | an ester |
| Charges (g) | | |
| Alkali metal hydroxide | 92 | 127 |
| Boric acid | 142 | 142 |
| Water | 665 | 665 |
| Carrier | 504 | 504 |
| Dispersant | 116 | 116 |
| Mole ratio alkali metal:boron | 1:1 | 1:1 |
| Alkali metal content (% b.w.) | 5.7 | 7.9 |

(II) Preparation of Boron-Free Metal Salt Dispersions

EXAMPLES 3 to 6

An aqueous solution of the potassium salt at a temperature of about 40° C. was added to a mixture of carrier (SN100 base oil) and dispersant (a commercially available pentaerythritol monopibsate ester) over a period of 30 minutes in a laboratory homogeniser (500–600 bar) for 2–3 hours, whereupon much of the water evaporated. The resulting liquid was drained from the homogeniser and used without further treatment.

Specific combinations and charges are given in Table 2.

TABLE 2

| | Example 3 | Example 4 | Example 5 | Example 6 |
|---|---|---|---|---|
| COMPOSITION | | | | |
| Metal salt | Potassium acetate | Potassium bicarbonate | Potassium carbonate | Potassium carbonate |
| Carrier | SN 100 | SN 100 | SN 100 | SN 100 |
| Dispersant | PMPE | PMPE | PMPE | PMPE |
| CHARGE (g) | | | | |
| Metal salt | 220 | 220 | 220 | 270 |
| Water | 665 | 665 | 665 | 665 |
| Carrier | 500 | 500 | 500 | 500 |
| Dispersant | 120 | 120 | 120 | 120 |
| ANALYTICAL DATA | | | | |
| % K (w/w) | 6.15 | 3.70 | 10.96 | 14.83 |
| % S (w/w) | 0.47 | 0.55 | 0.46 | 0.42 |
| % $CO_2$ (w/w) | — | 1.1 | 2.7 | 3.5 |
| % $H_2O$ (w/w) | 6.8 | 2.6 | 5.4 | 4.2 |
| % sediment (vol. in heptane) | 0.02 | 0.02 | 0.16 | 0.12 |
| $V_{100}$ (cSt) | 10.1 | 6.4 | 8.1 | 8.6 |
| $V_{40}$ (cSt) | 55.4 | 37.7 | 44.0 | 45.2 |
| TAN (mg KOH $g^{-1}$) | 0.91 | 13.7 | 20.5 | 9.9 |
| TBN (mg KOH $g^{-1}$) | 93.3 | 52.4 | 155.7 | 161.0 |
| AV (mg KOH $g^{-1}$) | 91.9 | 54.6 | 160.3 | 211.9 |

(B) ENGINE TESTING

(a) Engine

Valve seat recession tests were carried out in a Ford Industrial Engine having a 2.2 litre displacement.

(b) Basic Test Procedure

Literature has shown that exhaust valve seat recession is more likely to occur during high speed, high load conditions. The following test conditions were used in all tests:

| Test Conditions | |
|---|---|
| Engine Speed RPM | 2100 ± 20 |
| Load | WOT (Wide-Open Throttle) |

Tests were run for 40 hours.

(c) Fuel

The base fuel was unleaded Indolene.

(d) Cylinder Head Rebuild

The cylinder head was rebuilt for each test. In each case, new exhaust valves, exhaust valve seat inserts, and intake valve seals were installed. Valve seat inserts were checked for hardness and only those between 10 and 20 Rockwell "C" hardness were selected for testing. Valve guides were either replaced or knurled and reamed as necessary to maintain specified clearances. In most cases, the exhaust valve guides were replaced every other cylinder head rebuild and the intake valve guides every third or fourth rebuild. Valve springs were replaced as necessary.

(e) Compositions Tested

The formulations of Examples 1, 2, 4 and 6 were tested in combination with a detergent additive system which was used at 700 ppm by volume on the base fuel. The formulation of Example 1 was used at 172 ppm by volume and contributed 11.0 ppm w/v sodium to the base fuel. The formulation of Example 2 was used at 122 ppm by volume and contributed 9.7 ppm w/v to the test gasoline.

Comparison Test 1

Examples 1 and 2 were repeated except that the compositions (e) were omitted.

Comparison Test 2

Examples 1 and 2 were repeated except that the compositions (e) were omitted and in their place was used lead at a concentration of 0.15 g/l.

The results of Examples 1 and 2 and Comparison Tests 1 and 2 are given in Table 3.

The results of Examples 4 and 6 together with those for the unleaded base are given in Table 4.

TABLE 3

Valve Seat Recession Test Results for Boronated Additives

| Fuel | Additive | Test Time (hours) | Average Valve Recession Master Valve ($10^{-3}$ inch) |
|---|---|---|---|
| Unleaded | None | 40 | 28.0 |
| Leaded | Pb 0.15 $gl^{-1}$ | 40 | 0.8 |
| Unleaded | Ex. 1 | 40 | 1.8 |
| Unleaded | Ex. 2 | 40 | 1.8 |

TABLE 4

Valve Seat Recession Test Results for Boron-Free Additives

| Fuel | Additive | Test Time (hours) | Average Valve Recession Master Valve ($10^{-3}$ inch) |
|---|---|---|---|
| Unleaded | None | 40 | 28.7 |
| Unleaded | Ex. 4 | 40 | 2.4 |
| Unleaded | Ex. 6 | 40 | 1.3 |

The results reported in Tables 3 and 4 demonstrate that the additives according to the invention are effective for reducing valve seat recession in unleaded fuels.

We claim:

1. A fuel composition for use in internal combustion engines which comprises:

(A) a major amount of a fuel suitable for use in a spark ignition internal combustion engine comprising either a lead-free or low-lead fuel and (B) a minor amount of a composition comprising a metal salt in the form of a particulate dispersion, said metal salt selected from the group consisting of water soluble potassium salts of a carbonic acid, and boric acid.

2. A fuel composition according to claim 1 wherein the metal salt is selected from the group consisting of potassium bicarbonate, potassium carbonate and potassium borate.

3. A fuel composition according to claim 1 wherein component (B) incorporates a carrier for the metal salt.

4. A fuel composition according to claim 3 wherein the metal salt is incorporated in the carrier in the form of a particulate dispersion having a mean particle size of less than 1 micron.

5. A fuel composition according to claim 4 wherein the mean particle size is less than 0.5 micron.

6. A fuel composition according to claim 1 wherein the amount of component (B) in the composition is sufficient to provide at least 2 ppm of metal based on the total weight of the composition.

7. A fuel composition according to claim 1 wherein the metal salt is either potassium carbonate or potassium bicarbonate.

8. A fuel composition for use in internal combustion engines which composition comprises (A) a major amount of a fuel suitable for use in an internal combustion engine and (B) a minor amount of a composition comprising potassium borate in the form of a particulate dispersion in a carrier, the molar ratio of boron to metal being in the range from 0.33 to about 4.5.

9. A fuel composition according to claim 8 wherein the molar ratio of metal to boron is in the range from 0.33 to 2.5.

10. A fuel composition according to claim 9 wherein the molar ratio of metal to boron is about 1:1.

11. A fuel composition for use in internal combustion engines which comprises:

(A) a major amount of a fuel suitable for use in an internal combustion engine comprising either a lead-free or low-lead fuel and (B) a minor amount of a composition comprising potassium borate in the form of a particulate dispersion is prepared by wholly or partially desolvating a solvent-in-carrier emulsion of a solution of potassium hydroxide and boric acid to provide a boron to potassium molar ratio of Z/3 (wherein Z is the valency of the metal) to 4.5.

12. A fuel composition according to claim 11 wherein the metal salt of (B) is potassium borate and component (B) is prepared by introducing into an inert, nonpolar carrier an aqueous solution of potassium hydroxide and boric acid and an emulsifier, vigorously agitating the mixture to provide an emulsion of the aqueous solution in the carrier and then heating at a temperature and for a time sufficient to provide the predetermined degree of hydration in the emulsion.

13. A fuel composition for use in internal combustion engines which comprises:

(A) a major amount of a fuel suitable for use in an internal combustion engine comprising either lead free or low-lead fuel and (B) a minor amount of a composition comprising potassium borate in the form of a particulate dispersion prepared by reacting a potassium carbonate-overbased carrier-soluble alkali metal sulphonate with boric acid in an amount sufficient to produce an intermediate borate having a boron to potassium molar ratio of at least 5 and reacting the intermediate potassium borate with sufficient potassium hydroxide to produce a potassium borate having a boron to potassium metal molar ratio in the range from 0.33 to 4.5.

* * * * *